United States Patent [19]

Gertz

[11] 4,218,093

[45] Aug. 19, 1980

[54] MASSAGE OTTOMAN

[76] Inventor: Herman F. Gertz, 1016 N. Monroe St., Monroe, Mich. 48161

[21] Appl. No.: 24,610

[22] Filed: Mar. 28, 1979

[51] Int. Cl.[2] ..... A47C 9/00

[52] U.S. Cl. ..... 297/439; 128/57; 272/93; 297/270; 297/461

[58] Field of Search ..... 128/57; 272/93, 96; 297/423, 438, 439, 461, 462

[56] References Cited

U.S. PATENT DOCUMENTS

| | | | |
|---|---|---|---|
| 1,914,473 | 6/1933 | Wilson | 297/270 X |
| 2,097,087 | 10/1937 | McKane | 297/439 |
| 3,037,500 | 6/1962 | Daugherty | 272/96 X |
| 3,563,605 | 2/1971 | Pinkas | 297/439 |

*Primary Examiner*—James C. Mitchell

*Attorney, Agent, or Firm*—Fisher, Gerhardt, Crampton & Groh

[57] ABSTRACT

A floor supported furniture piece comprising a cylindrical shell, whose lateral wall extends curvilinearly about a major longitudinal axis and is adapted to engage and be supported and in rolling contact with a supporting floor and having two pairs of feet, one pair of which is mounted at one of the ends of the shell, and the other of which is mounted at the other end of the shell, the feet extending radially of the shell end in circumferentially spaced angular relation to each other, each foot having a surface extending arcuately and outwardly from the shell wall from a point at one of opposite ends of a line extending chordally and athwart the shell end to a point radially spaced from the shell wall to project beyond the shell lateral wall and adapted to engage the floor and thereby the limitative of rolling movement of the shell.

3 Claims, 4 Drawing Figures

MASSAGE OTTOMAN

SUMMARY OF INVENTION

The invention relates to the problem of extending the adaptability of a conventional chair or rocker to provide the greater ease of leg support and, in movement, the benefits of a local massage of the legs or ankles so supported.

This problem has received the attention of the prior art, as is indicated by the U.S. Pat. Nos. to HARTE, 390,520; WALLACE, 1,217,246; MEAD, 2,085,164; McKANE, 2,097,087; PARENT, 2,822,861; O'-LEARY, 2,856,986; BRANTL, 2,983,309; DEADY, 2,991,126; HENNESSEY, 3,554,600; SMITH, 3,556,591; and PINKAS, 3,563,605. Many of these devices are structurally and purposefully unsymmetrical, requiring the user, in effect, to veritably mount the device or adjust the same to the user's body position. Hence, the devices are ungainly and have unsightly projecting parts as in Harte, Mead, O'Leary, Brantl, Hennessey, Smith and Pinkas, or are cumbersome and weighty, as in Wallace, McKane, Parent and Deady.

It is the object of my invention to provide a massage ottoman furniture piece of light weight, being essentially of a hollow or tubular shell structure, compact and symmetrical and therefore adaptable and compatible to association with conventional living room furniture. Control of an embodiment of my invention, in its to-and-fro rocking potential, is obtained by feet that extend but shortly beyond the shell outer surface and radially thereof from spaced points arcuately spaced about each of the shell ends.

The embodiment, by reason of its light weight and compact structure, may be easily and quickly moved from place to place, being preferably provided with a strap bail for that purpose. Optionally, the shell, though aesthetically finished, is devoid of any surface upholstery. In place of upholstery, the ottoman of my invention may support, as by the mentioned strap bail, a polyethylene or rubber top cushion. The cushion stimulates, when the user's legs and ankles engage the same, an impression to the ottoman user that is said to be "like floating on air".

DESCRIPTION OF PREFERRED EMBODIMENT

Figure 1:
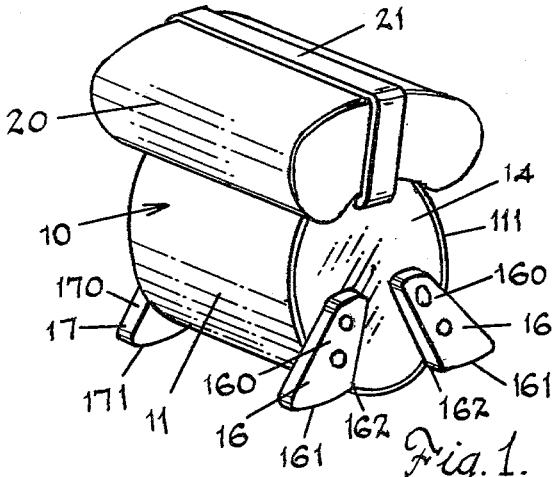
FIG. 1 of the accompanying drawings illustrates a perspective view of a massage ottoman embodying the features of my invention.

An embodiment of my invention has, as is illustrated in the accompanying drawings, a hollow tubular or cylindrical shell 10. The shell has an uninterrupted curvilinear extending wall 11, the major longitudinal axis of which, indicated diagrammatically in the drawings by the broken line 12, normally extends in a horizontal plane. The shell 10 is adapted to be floor supported, as shown at 100 in FIG. 4 of the drawings, and rest in rolling contact therewith.

The shell 10 may be constructed of any of a variety of materials, such as paper board or light sheet metal. A desired integration and reinforcement of the shell wall 11 may be provided by the inclusion of tube ends 14 and 15.

The tube ends 14 and 15 may be disc bodies of the same material as the shell wall 11. Each tube end 14 and 15 fits, as shown in the drawings, in nesting end closing relation to the end edges 111 of the shell wall. Thus, the shell 10 becomes a closed self-contained structure, compact, dustproof, and of light weight, features of considerable importance to the householder. If desired, the exterior surfaces 112, 141 and 151 of the shell wall 11 and ends 14 and 15 may be suitably finished, as by a stain or color coat, consonant with the furniture and taste of the householder. Preferably, for reasons that will appear, the cylindrical surface 112, however, remains free of upholstery.

Figure 2:
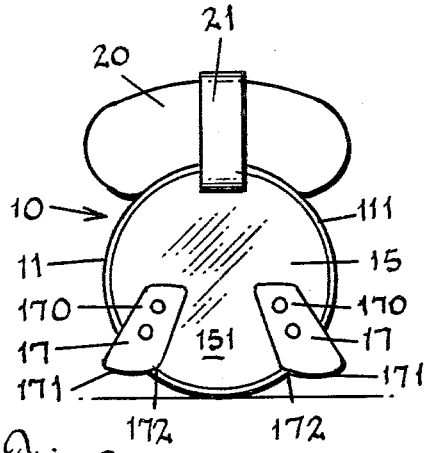
FIG. 2 of the drawings illustrates an end view of the ottoman shown in FIG. 1.
Figure 3:
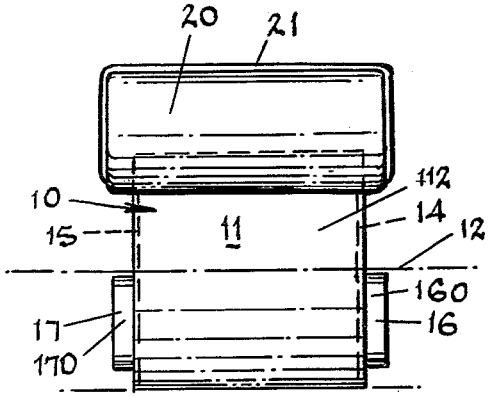
FIG. 3 of the drawings illustrates a view in side elevation of the embodiment shown in FIGS. 1 and 2.

Preferably, I provide two pair of feet, of which pair 16 may be mounted, as will be described, on the tube end 14, at one end of the shell wall 11, and the other, pair 17, as will be also described, on the tube end 15, at the other end of the shell wall 11. If desired, each of the pairs of feet 16 and 17 may be extensions of each of a pair of tapered legs 160 and 170 respectively. As shown in FIG. 2 of the drawings, each pair of tapered legs is fixedly mounted on one of the tube ends, the legs 160 on end 14 and the legs 170 on end 15. One leg of each pair of legs is disposed in angularly spaced relation to the major longitudinal axis 12 of the shell wall 11 and at substantially the same clock position about the axis 12 as the legs of the other pair. Thus, the tapered legs 160 and 170 support the feet 16 and 17 of their respectively associated pairs of feet in spaced relation to each other and in projecting relation to the end edges 111 of the shell wall 11.

The feet 16 and 17 preferably have substantially arcuate tread portions 161 and 171, respectively. The more nearly proximate ends of the arcuate tread portions 161 of the feet 16 and of the arcuate tread portions 171 of the feet 17, each intersect the circumferential perimeter of the shell wall 11, at respectively indicated points 162 and 172, shown in FIGS. 1 and 4 of the drawings. The tread portions 161 and 171 arc radially away from the shell wall 11 progressively as the tread portions extend from the intersecting points 162 and 172, as will be seen in FIG. 2 of the drawings. This feature provides a graduated and increasing, rather than an abrupt, check to the roll of the shell 10 beyond desired limits of its to-and-fro movement.

Figure 4:
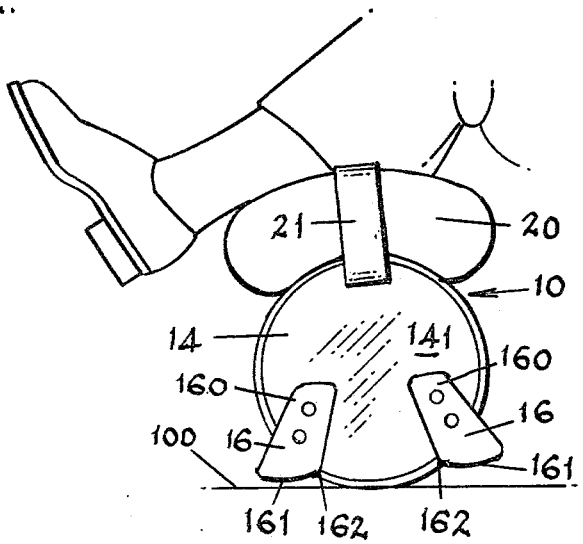
FIG. 4 illustrates the massage ottoman shown in FIG. 1 in use and in user leg supporting and massaging relation.

In order to provide a yielding and massaging support of the user's legs and ankles, as shown in FIG. 4 of the drawings, I provide the shell 10 with a cushion 20. The cushion 20 may be of a squashy foam rubber type material, loosely mounted on the shell 10 in diametrically opposite relation to the feet 16 and 17. The cushion 20 is held in place by a fabric or tape bail 21 whose opposite ends may be suitably attached, as to the tube ends 14 and 15. The bail 21 serves not only to hold the cushion 20 in place, as described, but also provides a convenient handle for lifting and placing the ottoman as desired in reference to use.

It will thus be seen that I provide a leg and ankle massage ottoman adaptable to use with conventional furniture, such as chair, rocker or lounge types. An embodiment of my invention is compact, light weight and easily moved about. When positioned for use, the ottoman gives floating and adapting support to the user's legs and ankles, particularly to the calf muscles of the legs. Control of the ottoman movement is such that the limitation stop action at each extremity of its to-and-fro movement is exerted gradually and increasingly, rather than abruptly, to the continued ease of the user.

I claim:

1. A massage ottoman comprising a cylindrical shell having an uninterrupted curvilinear extending lateral wall in parallel relation to a horizontally extending major longitudinal axis and adapted to be floor engaging and supported for rolling contact therewith;

a pair of feet;

each foot of the pair of feet being in engagement with and extending substantially radially of the mentioned curvilinearly extending wall, in a circumferentially spaced angular relation less than a normal angle to the other foot of the mentioned pair of feet;

each foot having a surface arcuately extending outwardly from the lateral shell wall from a point at one of opposite ends of a line extending in chordal relation to the discular wall part and adapted, when the cylindrical shell rolls in a direction toward that in which the stay end component extends, to engage the floor and limit the further rolling movement of the shell.

2. In a massage ottoman, as described in claim 1, having in addition thereto:

a pair of discular wall parts of which one is in engagement with one end and the other of which is in engagement with the opposite end of the cylindrical shell lateral wall;

a second pair of feet, each of which is in engagement with and extends radially of and beyond the aforesaid circumferentially extending wall in a circumferentially spaced angular relation less than a normal angle to the other foot of the mentioned second pair of feet;

each foot of the second pair of feet having a surface arcuately extending outwardly from the lateral shell wall from a point at one of opposite ends of a line extending in chordal relation to the circumferentially extending wall and adapted, when the cylindrical shell rolls in a direction toward that in which the foot of one of the first mentioned feet extends, to engage the floor and cooperate therewith in limiting further rolling movement of the shell.

3. A massage ottoman as described in claim 2, having in addition thereto:

a cushion adapted to rest upon the lateral wall surface in a position substantially diametrically opposite the mentioned pairs of feet; and a strap having one end thereof in engagement with the first mentioned discular wall part and the other end in engagement with the second mentioned discular wall part providing a bail handle for holding the cushion in place on the mentioned lateral wall surface and for manually transporting the massage ottoman.

* * * * *